US008910889B2

(12) United States Patent
Kamkar et al.

(10) Patent No.: US 8,910,889 B2
(45) Date of Patent: Dec. 16, 2014

(54) PROCESS AND A DEVICE TO CLEAN SUBSTRATES

(75) Inventors: Kirtan Shravan Kamkar, Bangalore (IN); Rudra Saurabh Shresth, Bangalore (IN); Arpita Bhattacharya, Bangalore (IN)

(73) Assignee: Conopco, Inc., Englewood Cliffs, NJ (US)

( * ) Notice: Subject to any disclaimer, the term of this patent is extended or adjusted under 35 U.S.C. 154(b) by 450 days.

(21) Appl. No.: 13/390,443

(22) PCT Filed: Aug. 9, 2010

(86) PCT No.: PCT/EP2010/061556

§ 371 (c)(1), (2), (4) Date: Feb. 14, 2012

(87) PCT Pub. No.: WO2011/020733

PCT Pub. Date: Feb. 24, 2011

(65) Prior Publication Data

US 2012/0138708 A1 Jun. 7, 2012

(30) Foreign Application Priority Data

Aug. 19, 2009 (IN) ..... 1903/MUM/2009

(51) Int. Cl.

| | |
|---|---|
| ***B05B 1/28*** | (2006.01) |
| ***B05B 7/04*** | (2006.01) |
| ***F23D 11/10*** | (2006.01) |
| ***C11D 11/00*** | (2006.01) |
| ***B05B 7/08*** | (2006.01) |
| ***B08B 3/02*** | (2006.01) |
| ***B08B 5/02*** | (2006.01) |

(52) U.S. Cl.

CPC ..... *C11D 11/00* (2013.01); *B05B 7/0815* (2013.01); *B05B 7/0416* (2013.01); *B05B 7/0807* (2013.01); *B08B 3/02* (2013.01); *B08B 3/026* (2013.01); *B08B 5/02* (2013.01)

USPC ..... 239/433; 239/290; 239/292; 239/295; 239/418

(58) Field of Classification Search

CPC .... B05B 7/0416; B05B 7/0807; B05B 7/0815

USPC ..... 239/290, 292, 294, 295, 418, 433

See application file for complete search history.

(56) References Cited

U.S. PATENT DOCUMENTS

| | | | |
|---|---|---|---|
| 3,021,702 | A | 2/1962 | Houser |
| 3,108,465 | A | 10/1963 | Bochan |

(Continued)

FOREIGN PATENT DOCUMENTS

| | | | |
|---|---|---|---|
| CH | 423720 | A | 11/1966 |
| CH | 423720 | | 11/1996 |

(Continued)

OTHER PUBLICATIONS

PCT International Search Report in PCT application PCT/EP2010/061556 dated Apr. 14, 2011 with Written Opinion.

(Continued)

*Primary Examiner* — Ryan Reis

(74) *Attorney, Agent, or Firm* — Greenberg Traurig, LLP

(57) ABSTRACT

The present invention relates to a process and a device for cleaning substrates. In particular the invention relates to an air-water jet device connected to a detergent dosing system. It is therefore an object of the present invention to provide air-water jet device for cleaning fabric articles with enhanced performance; and to provide a dosing device for a detergent composition that may be connected to an air-water jet device. Surprisingly it has been found that a dispensing chamber for a detergent composition DET between the water source and the outlet of the water nozzle provides improved cleaning of an air-water jet.

3 Claims, 3 Drawing Sheets

(56) References Cited

U.S. PATENT DOCUMENTS

| | | | | |
|---|---|---|---|---|
| 4,127,913 | A | 12/1978 | Monson | |
| 4,286,949 | A | 9/1981 | Holt, Jr. | |
| 4,569,483 | A * | 2/1986 | Oberdorfer | 239/305 |
| 4,787,404 | A | 11/1988 | Klosterman | |
| 4,793,332 | A | 12/1988 | Klein | |
| 4,998,993 | A * | 3/1991 | Kenderi et al. | 239/295 |
| 5,001,806 | A | 3/1991 | Gurstein | |
| 5,505,915 | A | 4/1996 | Copeland | |
| 5,593,304 | A | 1/1997 | Ram | |
| 5,820,373 | A | 10/1998 | Okano | |
| 5,930,858 | A | 8/1999 | Jung | |
| 5,943,723 | A | 8/1999 | Hilfinger | |
| 5,960,503 | A | 10/1999 | Del Pozo Y Mattei | |
| 5,974,615 | A | 11/1999 | Schwarz-Hartmann | |
| 6,264,119 | B1 | 7/2001 | Truong | |
| 6,386,466 | B1 | 5/2002 | Ozawa | |
| 6,457,974 | B1 * | 10/2002 | Sharp et al. | 433/88 |
| 6,547,974 | B1 | 4/2003 | Albrechta | |
| 7,021,571 | B1 | 4/2006 | Lawson | |
| 8,016,949 | B2 * | 9/2011 | Jayaraman et al. | 134/36 |
| 2002/0059947 | A1 | 5/2002 | Sato | |
| 2002/0189641 | A1 | 12/2002 | Sato | |
| 2003/0205631 | A1 | 11/2003 | Barron | |
| 2004/0087158 | A1 | 5/2004 | Izumi | |
| 2004/0202980 | A1 | 10/2004 | Policicchio | |
| 2004/0261194 | A1 | 12/2004 | Price et al. | |
| 2006/0078844 | A1 | 4/2006 | Goldman | |
| 2008/0006303 | A1 | 1/2008 | Butterbaugh et al. | |
| 2008/0135639 | A1 | 6/2008 | Winters | |
| 2008/0283090 | A1 | 11/2008 | DeKraker et al. | |
| 2008/0295864 | A1 | 12/2008 | Turner | |
| 2010/0038449 | A1 * | 2/2010 | Archetti | 239/125 |

FOREIGN PATENT DOCUMENTS

| | | | |
|---|---|---|---|
| DE | 202005019242 | U | 8/2006 |
| DE | 202005019242 | U1 | 8/2006 |
| EP | 0140505 | A1 | 5/1985 |
| EP | 0248638 | A2 | 12/1987 |
| EP | 0790809 | B1 | 12/1998 |
| EP | 0862390 | B1 | 9/1999 |
| EP | 1250959 | A1 | 10/2002 |
| EP | 1306136 | A1 | 5/2003 |
| EP | 1737025 | A1 | 12/2006 |
| EP | 1870381 | A1 | 12/2007 |
| FR | 1014273 | | 8/1952 |
| FR | 1094132 | | 5/1955 |
| FR | 1108989 | | 1/1956 |
| FR | 1281617 | | 1/1962 |
| FR | 2583630 | | 12/1986 |
| FR | 2583630 | A1 | 12/1986 |
| GB | 1049162 | | 11/1966 |
| JP | 03296475 | A | 12/1991 |
| JP | 5115676 | A | 5/1993 |
| JP | 7275678 | A | 10/1995 |
| JP | 11128590 | A | 5/1999 |
| JP | 2000140716 | A | 5/2000 |
| JP | 2000317412 | | 11/2000 |
| JP | 2000345199 | A | 12/2000 |
| JP | 2001300355 | A | 10/2001 |
| JP | 2001321391 | | 11/2001 |
| JP | 2006341183 | A | 12/2006 |
| JP | 2007529634 | A | 10/2007 |
| WO | WO8403237 | A1 | 8/1984 |
| WO | WO9936499 | | 7/1999 |
| WO | WO02072274 | A1 | 9/2002 |
| WO | WO03102289 | A1 | 12/2003 |
| WO | WO2006041920 | A1 | 4/2006 |
| WO | WO2008155025 | A1 | 12/2008 |
| WO | WO2009103595 | A1 | 8/2009 |
| WO | WO2011020730 | A1 | 2/2011 |
| WO | WO2011020731 | A3 | 2/2011 |
| WO | WO2011020733 | A3 | 2/2011 |
| WO | WO2011020734 | A2 | 2/2011 |

OTHER PUBLICATIONS

European Search Report in EP application EP 09 17 3659 dated Feb. 11, 2010.

PCT International Search Report in PCT application PCT/EP2010/061557 dated Apr. 14, 2011 with Written Opinion.

European Search Report in EP application EP 09 17 3663 dated Nov. 30, 2009.

PCT International Search Report in PCT application PCT/EP2010/061552 dated Nov. 5, 2010 with Written Opinion.

European Search Report in EP application EP 09 17 3652 dated Apr. 30, 2010.

PCT International Search Report in PCT application PCT/EP2010/061554 dated Apr. 14, 2011 with Written Opinion.

European Search Report in EP application EP 09 17 3657 dated Apr. 30, 2010.

First Action Interview Pilot Program Pre-Interview Communication Issued Feb. 12, 2014 in U.S. Appl. No. 13/390,430.

Notice of Allowance and Fees Due Issued Apr. 7, 2014 in U.S. Appl. No. 13/390,430.

Final Office Action Issued Oct. 24, 2013 in U.S. Appl. No. 13/390,436.

Notice of Allowance and Fees Due Issued Dec. 6, 2013 in U.S. Appl. No. 13/390,436.

* cited by examiner

PROCESS AND A DEVICE TO CLEAN SUBSTRATES

TECHNICAL FIELD

The present invention relates to a process and a device for cleaning substrates. In particular the invention relates to an air-water jet device connected to a detergent dosing system.

BACKGROUND AND PRIOR ART

Washing of fabric articles is a commonly used process throughout the world. A specific problem with all machine wash processes is that machine washing processes do not always remove stains on fabric articles. In hand wash processes, special attention can be provided to stains, but in washing machines this attention is generally absent.

One way of making sure that stains are removed is the application of a pre-treatment composition onto the stain, prior to the start of the washing process. Another way is to manually remove the stain before washing. Both methods are commonly used in the art.

Another way of pre-treatment is the use of a water sprays to utilise hydrodynamic stress for the removal of stains. Sprays, generally defined as either high speed liquids e.g. water, or a combination of water and air, have been used to clean hard and non-porous surfaces e.g. automobiles, walls and, metallic vessels.

U.S. Pat. No. 4,787,404 (IBM, 1988) discloses a low flow-rate pressure atomizer device which is so dimensioned and operated as to accelerate a gas to substantially sonic velocity and cause it to break up a cleaning liquid. It also discloses input at a high pressure into small droplets and acceleration of these droplets to at least half the velocity of said gas, to create shear stress at a surface adjacent the exit end of said device, thereby removing the contaminants from said surface.

FR-B-1108989 discloses a process to clean a substrate by subjecting the substrate to an air-water spray generated by a spraying means comprising an air passage and a water passage.

US 2002/189641 discloses a device for cleaning a soiled surface, the device comprising a feed water container and an air compressor in communication with the spray nozzle comprising a water passage and an air passage.

Both of the above mentioned devices provide an air water spray that is mixed inside the device. The disadvantage of such system is that the water flow cannot be reliably regulated because the air pressure goes against the direction of the water flow. This is especially problematic when a low water-to-air ratio (for instance in water:air ratios of less than 1:9) is required or a low water flow-rate if used. The nozzles of the prior art are not suitable for this purpose.

EP 0 140 505 discloses an industrial component fluid let having a nozzle comprising two coaxial tubes. The outer tube has a stepped bore. An annular swirl plate is spiqotted into an intermediate diameter bore portion and has an end of the inner tube spiqotted into it. Cleaning fluid passed through the swirl plate emerges into a chamber with an axial directional component and a spinning action to form a hollow cone spray. Fluid emerging from the inner tube only forms a pinpoint iet but cooperates with spinning fluid emerging simultaneously from the swirl plate to form a solid cone jet. The let may be operated and orientated by a robot.

U.S. Pat. No. 4,569,483 discloses an apparatus using a low pressure water stream, from a tap source, into which chemicals can be selectively introduced, and a high pressure water stream produced by a pump, into which chemicals can be selectively introduced, and an air stream into which chemicals can be selectively introduced. A heated water supply provides water for the high pressure stream. All the streams lead to a single spray pistol, the spray pistol having control switches for controlling the lines and chemicals.

EP1250959 discloses a cleaning device with a single nozzle that uses an internally mixed air, water and soap mixture for cleaning at high pressure. This prior art has only one nozzle and it is internally mixed and not suitable for this purpose.

A specific way of pre-treatment, described in our co-pending application PCT/EP2009/050869 (published as WO2009/103595), is the use of an air-water jet to remove a stain from a fabric article. The air-water jet device as described comprises of a nozzle design for the external mix of air and water and a compressor for providing the required air.

However, hydrodynamic stress alone does not always provide the required result.

It is therefore an object of the present invention to provide air-water jet device for cleaning fabric articles with enhanced performance.

It is a further object of the invention to provide a dosing device for a detergent composition that may be connected to an air-water jet device.

Surprisingly it has been found that a dispensing chamber for a detergent composition between the water source and the outlet of the water nozzle provides improved cleaning of an air-water jet.

SUMMARY OF THE INVENTION

Accordingly, the present invention provides a system comprising (a) an air-water jet device comprising: a first nozzle, which is in fluid communication with a feed water source, and a second nozzle connected to an air source; wherein both the first nozzle and the second nozzle are positioned relative to an imaginary central axis (NOR); the first nozzle being positioned at an angle ($\alpha$) of between 1 and 60° relative to the central axis; and the second nozzle is at an angle ($\phi$) of between 1 and 45° relative to the central axis; and wherein the mouth of the second nozzle is positioned more forward in the direction of the flow along the direction of the central axis than the mouth of the first nozzle, wherein the offset (OS) distance between the mouth of the first nozzle and the second nozzle is between 0.5 and 5 mm in said direction, and (b) detergent dosing device comprises a chamber comprising a detergent composition, positioned between the water source and the first nozzle; Wherein the detergent dosing device comprises and auto-shut-off device, characterised in that the shut-off device closes the water inlet and/or outlet of the dosing device, when the detergent composition is spent.

These and other aspects, features and advantages will become apparent to those of ordinary skill in the art from a reading of the following detailed description and the appended claims. For the avoidance of doubt, any feature of one aspect of the present invention may be utilised in any other aspect of the invention. The word "comprising" is intended to mean "including" but not necessarily "consisting of" or "composed of." In other words, the listed steps or options need not be exhaustive. It is noted that the examples given in the description below are intended to clarify the invention and are not intended to limit the invention to those examples per se. Similarly, all percentages are weight/weight percentages unless otherwise indicated. Except in the operating and comparative examples, or where otherwise explicitly indicated, all numbers in this description indicating amounts of material or conditions of reaction, physical properties of materials and/or use are to be understood as modified by the word "about. Numerical ranges expressed in the format "from x to y" are understood to include x and y. When for a specific feature multiple preferred ranges are described in the format "from x to y", it is understood that all ranges combining the different endpoints are also contemplated.

DETAILED DESCRIPTION OF THE INVENTION

Accordingly the invention provides a cleaning device with improved performance.

Air-Water Jet Device

The air-water jet device comprises two nozzles wherein a first nozzle is in fluid communication with a feed liquid source; and a second nozzle connected to a source of compressed air.

The water source may be any water source, either provided to the air-water jet device straight from the water mains, through a pump, through a pressured container holding the water or by any other means, or even by gravity (i.e. by placing the water reservoir above the height of use of the air-water jet.

Similarly, the air source may be any air source, either provided through a compressor, separate from or built into the device, or through a compressed air line, such as often available in hospitals and in dental clinics.

Both the first nozzle (water nozzle) and the second nozzle (air nozzle) are positioned relative to an imaginary central axis (NOR). The first nozzle is positioned at an angle ($\alpha$) of between 1 and 60° relative to the central axis, preferably between 10° and 30°; and the second nozzle is at an angle ($\phi$) of between 1 and 45° relative to the central axis, preferably between 15° and 30°.

The mouth of the second nozzle is positioned more forward in the direction of the flow along the direction of the central axis than the mouth of the first nozzle, wherein the offset (OS) distance between the mouth of the first nozzle and the second nozzle is between 0.5 and 5 mm in said direction, preferably 1-3 mm.

The best results are obtained when the first nozzle has an opening of between 0.05 and 10 $mm^2$, preferably even at least 0.2 $mm^2$, and not more than 7 $mm^2$, more preferably not more than 5 $mm^2$ or even less than and 3 $mm^2$. Similarly, the opening of the second nozzle is preferably between 0.2 and 3 $mm^2$.

The scope of the present invention further includes configurations comprising two or more water nozzles directed at a single air nozzle. Although this adds to the complexity of the device, which is generally not preferred, it provides the additional benefit of point of action mixing or reacting different or incompatible ingredients. It is further included in the scope of this invention that one of the liquid nozzles is used for dosing an ingredient without air flow, and another liquid nozzle is used with air flow, but not co-currently.

For nozzles with a circular opening, the diameter of the first nozzle is preferably between 0.25 and 3.5 mm, preferably at least 0.5 mm, but preferably not more than 3 mm, more preferably not more than 2.5 mm, or even less than 3 mm; while the diameter of the second nozzle is preferably between 0.5 and 2 mm.

Without wishing to be bound by a theory, it is thought that the present invention derives its performance from the positioning of the nozzles relative to the imaginary axis and the offset of the water nozzle (first nozzle) relative to the air nozzle (second nozzle). Because of this positioning, the water coming from the water nozzle forms a film around the air nozzle and because of this gives a finer spray at a lower water to air ratio (i.e. using less water). The air flow from the air nozzle is thought to create a local under pressure that ensures that the water is driven in the direction of the air nozzle along the air nozzle tip regardless of in which direction the nozzle is pointed. Furthermore, the water flow is not affected by the air pressure, due to the separation of the air and water nozzle openings, which is a common problem with internal mix nozzle designs.

It is therefore preferred that the water:air ratio is between 10:90 and 1:9999, more preferably less than 5:95, still more preferably less than 4:96, even more preferably less than 3:97, less than 2:98 or even less than 1:99, while the ratio is preferably higher than 3:9997, more preferably higher than 5:9995.

It is further preferred that there is only a short distance between the opening of the water nozzle and the side of the air nozzle, this distance is preferably less than 2 mm, more preferably less than 1 mm, or even less than 0.5 mm. It is most preferred that the opening of the water nozzle is touching the air nozzle.

It is preferred that the air nozzle does not co-axially surround the water passage. It is also preferred that the water nozzle does not co-axially surround the air nozzle The air pressure of the air source preferably is in the range of 1 to 4 bar. The air preferably has a velocity of greater than 80 m/s at the exit of the nozzle (the nozzle opening), preferably greater than 120 m/s, more preferably greater than 180 m/s, most preferably greater than 250 m/s are preferred. Although the invention would work up to very high air speeds, it is preferred for constructional reasons and convenience for the user that the air speed is less than the speed of sound (i.e. less than 334 m/s). Depending on the nozzle diameter, and the airflow rate is preferably between 3 and 50 l/min, preferably more than 5 l/min or even more than 10 l/min. The air flow rate is preferably less than 40 l/min, more preferably less than 30 l/min or even less than 25 l/min.

The water flow rate is typically between 2 and 50 ml/min, preferably more than 5 ml/min or even more than 10 ml/min, while the water flow rate is preferably less than 40 ml/min, preferably less than 30 ml/min or even less than 25 ml/min.

Configuration

The air and/or water sources may be incorporated into the device, or be fit in a separate unit. In the latter case a separate unit comprising a compressor, a compressed air cartridge or cylinder or another source of air and/or a water reservoir optionally connected to the water mains is provided that is connected to a hand held device by means of a tubing as air line and/or water line.

Compressor

The air jet device may further comprise an air compressor as air source. The compressor may be built into the handle of the device, or provided as a separate device that is connected to the air-water jet by means of a tube. The compressor, preferably provides at least 1 bar pressure and not more than 5 bar, preferably less than 4 bar. Thus, very low power compressors, typically in the range of 0.05 to 1 HP (=36.8 W-735 W), can be used to achieve the above specifications. Due to a pressure drop in the tubing and the device, the pressure at the air nozzle will preferably be in the range of 1 to 4 bar, preferably 2 to 3 bar. A device with a means to set the pressure is also contemplated; in this case the user is for instance able to choose between soft, medium and hard cleaning.

The water source may be the water mains, i.e. directly connected to the faucet, or be in the form of a separate reservoir. The water pressure for use with the device may be relatively low, preferably at least 0.05 bar, more preferably at least 0.1 bar, but preferably not more than 3 bar, more preferably less than 2.5 bar, still more preferably less than 2 bar.

When a separate reservoir is used as water source, said reservoir may be filled with water only, or a detergent composition. It is understood that in the context of this invention, terms like "water source", "water reservoir" and "water nozzle" are not limited to water, but include also detergent compositions, preferably aqueous detergent compositions. The water reservoir may be placed above the level of use of the cleaning device, such as to provide pressure, or may be pressured separately. When pressured separately, it is especially preferred that the reservoir is pressurised with compressed air from the compressed air source.

Detergent Dosing Device

The detergent dosing device is positioned between the water source and the water nozzle of the air-water jet.

The dosing device comprises a chamber holding a detergent composition, a water inlet and a water outlet.

When a solid detergent is used, the feed water, e.g. from a container or the water mains, is preferably passing through the chamber and contacts the detergent directly.

When a liquid composition is used, the liquid is preferably dosed from the container into the water line that is connected to the water nozzle. This dosing may be done by means of a metering pump, or a drip mechanism, but is most preferably done by means of a capillary connection between the water line and the chamber.

The dosing devices preferably comprises an auto-shut-off device that closes the water inlet and/or the water outlet when the detergent is spent. The auto-shut-off device may comprise any mechanism that closes the water inlet and/or the water outlet of the detergent dosing device. This may be a spring loaded valve, floating valve and/or an electronic solenoid valve. Spring loaded shut-off is preferably used in combination with solid detergents. A floating valve device is preferred in combination with liquid detergents.

The detergent composition may be a liquid or a solid. When the composition is in solid form, it is may be a powder, or a shaped solid such as a bar or tablet.

In general, the surfactants of the surfactant system may be chosen from the surfactants described well known textbooks like "Surface Active Agents" Vol. 1, by Schwartz & Perry, Interscience 1949, Vol. 2 by Schwartz, Perry & Berch, Interscience 1958, and/or the current edition of "McCutcheon's Emulsifiers and Detergents" published by Manufacturing Confectioners Company or in "Tenside-Taschenbuch", H. Stache, 2nd Edn., Carl Hauser Verlag, 1981.

Although any concentration of surfactant may be used, suitable concentration is in the range of 0.5 to 3 grams per liter based on the amount of liquid coming out of the air-water jet when in use.

In the present context the formulation may be a liquid, paste or powder Compositions in the context of the present invention include any composition that comprises a surfactant and one or more benefit agents. Such benefit agents may be dependent on the intended use. In general the detergent composition may broadly contain a surfactant, builders, salts, soil release and/or viscosifying polymers bleach and/or perfume.

Liquid detergent compositions further comprise a solvent, selected form water, ethanol and/or 2-propanol.

Preferred surfactants are LAS (linear alkyl benzene sulphonate), AES (alkyl ether sulphates), ethoxylated alcohol non-ionic surfactants, alkyl amine oxides, quaternary ammonium cationic surfactants, e.g. CTAB (cetyl trimethyl ammonium bromide), CTAC (cetyl trimethyl ammonium chloride) and/or BAC (benzalkonium chloride). The surfactant is preferably present in a concentration of 10-40% by weight based on the total composition, preferably at least 15%, preferably less than 30%.

Preferred builders are sodium carbonate, sodium bicarbonate, STPP, sodium citrate etc. Builder aids, such as calcite, may also be used. The builder is preferably present in a concentration of between 0 and 40%, preferably at least 10% and not more than 25%.

Preferred polymers are SCMC, PVP CP5 etc. Other commercial soil release and anti-redeposition polymers may also be used.

When the substrate to be cleaned is a chemical stain on a fabric, e.g. those that occur when fabrics are stained with bleachable stains resulting from foods and beverages like tea, coffee, soup, ketchup etc., it is preferred that the stain is pre-treated with a bleaching agent before it is treated with the process of the invention.

Suitable bleaching agents are hypohalites and peroxides. Percarbonate and bleaching powder (calcium hypochlorite) are especially preferred. When the bleach ingredient is not compatible with any one of the other ingredients of the detergent compositions, a second water nozzle and dosing device may be used. It is more preferred that bleach is dosed without air flow, to avoid exposure of the consumer to a bleach spray. Bleach may be present in a concentration of 0-10%, preferably between 5 and 8%.

The composition may further comprise minors, including perfumes, fluorescers, antimicrobial agents. Perfumes are generally appreciated by the consumer especially in direct application. The minors may be present in a concentration of between 0 and 2% w, preferably between 0.5 and 1.5%.

The invention will now be illustrated by means of the following non-limiting drawings and examples.

DETAILED DESCRIPTION OF THE DRAWINGS

FIG. 1 shows 8 views (A through H) of the device. A is a rear view of the device, B is a side view, C is a cross-sectional view of through plane "B" of view A, E is the top view of the device, F is an top/rear/side perspective view, and D, G and H are perspective, front/back and side view of a solid cartridge embodiment.

Figure 1A:
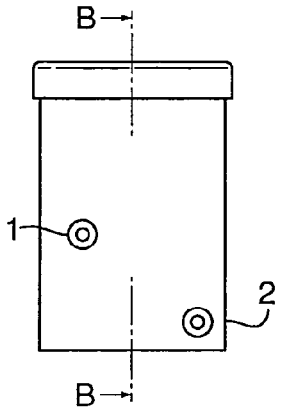
FIG. 1 shows a view of one embodiment of the device, comprising a solid detergent composition.
Figure 1B:
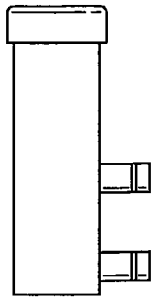
Figure 1C:
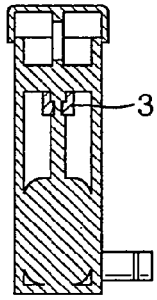
Figure 1D:
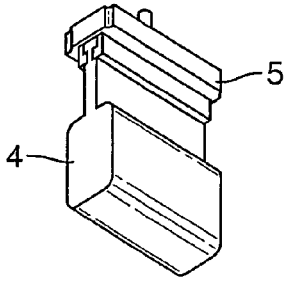
Figure 1E:
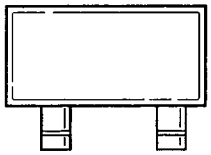
Figure 1F:
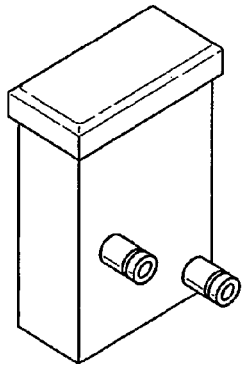
Figure 1G:
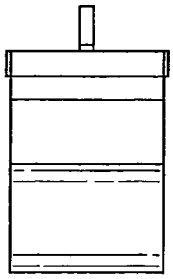
Figure 1H:
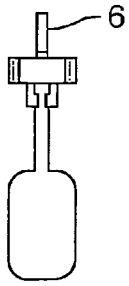
Figure 2:
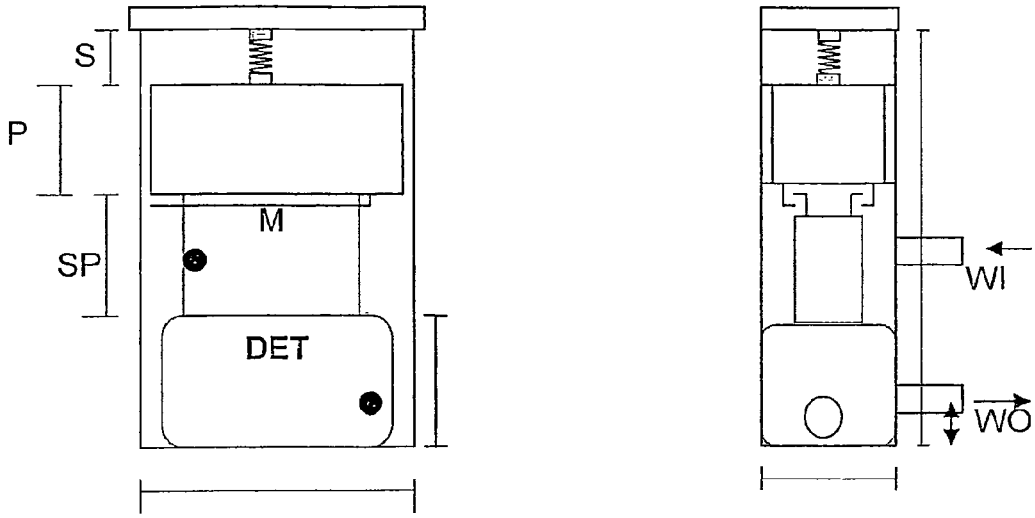
FIG. 2 shows the internal configuration of the same device.

FIG. 2 shows the internal configuration of a spring loading auto-shut-off embodiment of FIG. 1. S indicates a spring that pushes down a solid detergent compositions (DET) via a stopper (P) and a separator plate (M). The side view shows the water inlet (WI) and the water outlet (WO). It will be appreciated that when the detergent is spent, the stopper (P) will block the outlet port (WI).

Figure 3:
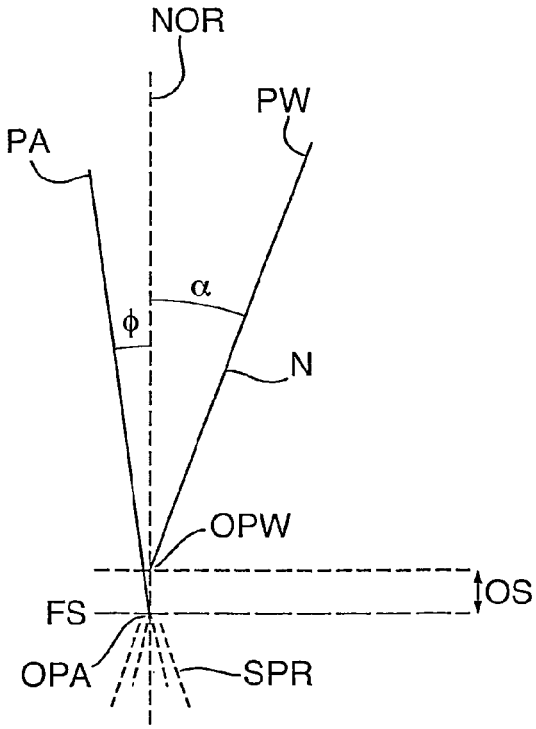
FIG. 3 shows a schematic drawing of the air-water jet nozzles

FIG. 3 shows a configuration wherein, the nozzle (N) has the outlet port for liquid (OPW) positioned away from the substrate relative to the outlet port for air (OPA), offset by a distance (OS). The angle of incidence of the outlet port for liquid with respect to the substrate (FS) is defined by the angle $\alpha$. The angle of incidence of the outlet port for air with respect to the substrate (FS) is defined by the angle $\phi$. The dashed line NOR represents an imaginary line which is normal to the surface of the substrate. As is apparent, in this embodiment of the nozzle the angle α is greater than the angle ϕ. The air exits from the nozzle through outlet port for air (OPA) and the liquid exits through the outlet port for liquid (OPW).

Figure 4:
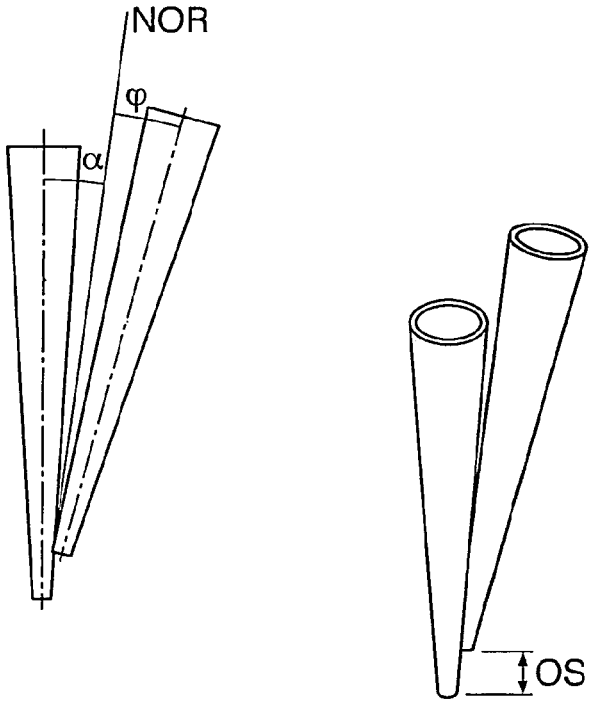
FIGS. 4 and 5 show 3-D drawings of the air-water jet nozzles in different embodiments.

FIG. 4 shows a 3-D view of the configuration of FIG. 3

Figure 5:
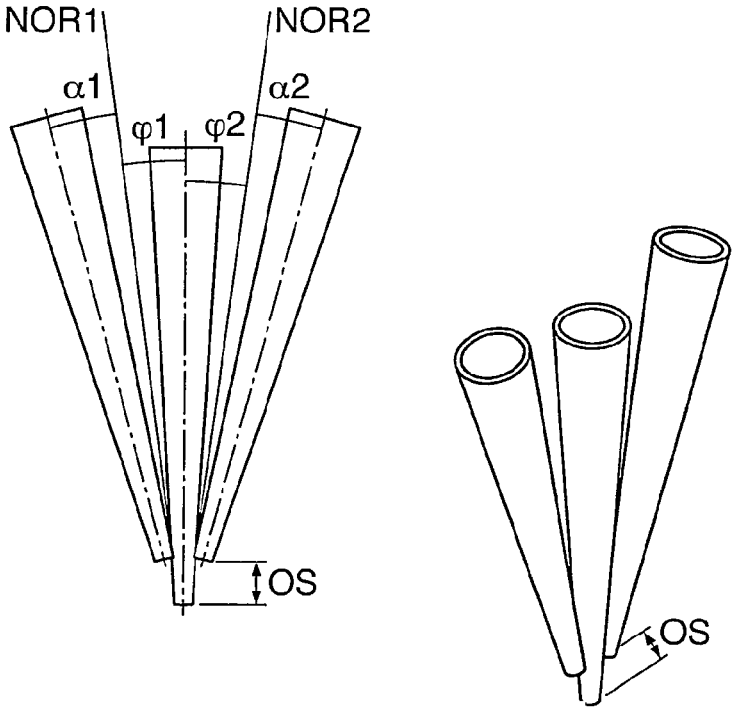

FIG. 5 shows a 3-D view of a configuration with 1 air nozzle and 2 water nozzles.

EXAMPLES

Example 1

Constant Cleaning Performance

A set of 25 poly/cotton test swatches soiled with a mixture of particulate and fatty soils, (WFK-20D, ex WFK Germany), were sequentially washed using an air-water jet device wherein the water line was connected to a dosing device according to the invention. The dosing device contained a detergent composition In example 1, the detergent composition was, a commercially available detergent (SURF® XL powder, ex Unilever)

In example 2, the detergent composition contained 30% ethoxylated alcohol non-ionic surfactant (C12-EO7), 30% $Na_2CO_3$ and 40% water.

In example 3, the detergent composition contained 30% sodium linear alkyl benzene sulphonate, 30% $Na_2CO_3$ and 40% sodium chloride.

In example 4, the detergent composition contained 30% magnesium linear alkyl benzene sulphonate, 30% $Na_2CO_3$ and 40% sodium chloride.

The cleaning was measured in terms of Delta-R refectance at a wave length of 460 nm in a Gretag Macbeth reflectometer, wherein Delta-R is calculated as the reflectance after cleaning minus the reflectance before cleaning. This method is widely used in the industry.

TABLE 1

Results

| Example composition | Average Delta-R (460 nm) | Standard deviation |
|---|---|---|
| 1 | 15.4 | 1.36 |
| 2 | 16.3 | 0.80 |
| 3 | 17.2 | 0.92 |
| 4 | 16.1 | 1.53 |

The table above shows that the system provides a constant cleaning performance of about 15-17 point of Delta-R (460 nm) over a test set of 25 washes, with a low standard deviation.

Example 2

Constant Dosage of Detergent to the Water

The dosing device according to the invention was fitted to a water source. The chamber in the dosing device contained solid commercially available washing detergent powder, comprising 20% of Sodium alkyl benzene sulphonate (NaLAS), 40% of builder and 39% electrolytes 1% minors (perfume, fluorescer and enzymes)

The device was operated by running 2 liters of water through the chamber at a flow rate of 15 ml/min for 200 min. A sample was taken after every 200 ml of liquid passing through the system at the outlet of the chamber. The concentration of NaLAS was measured by hyamine titration.

TABLE

Results of example 2

| Vol (ml) | LAS (g/l) |
|---|---|
| 200 | 0.368 |
| 400 | 1.398 |
| 600 | 1.693 |
| 800 | 1.546 |
| 1000 | 1.546 |
| 1200 | 1.472 |
| 1400 | 1.987 |
| 1600 | 1.619 |
| 1800 | 1.619 |
| 2000 | 1.546 |

The results demonstrate that the dispensing device according to the invention provides a constant dosing of detergent to the water over an extended volume of water.

The invention claimed is:

1. A system comprising a. an air-water jet device configured for cleaning a substrate comprising a first nozzle and a second nozzle, i. the first nozzle is in fluid communication with a feed water source; and ii. the second nozzle is connected to an air source;

wherein both the first nozzle and the second nozzle are positioned relative to a central axis (NOR);

wherein the first nozzle is at an angle (α) of between 1 and 60° relative to the central axis;

wherein the second nozzle is at an angle (ϕ) of between 1 and 45° relative to the central axis;

wherein the central axis is normal to a surface of the substrate;

wherein a mouth of the second nozzle is positioned more forward along the central axis in the direction of flow than a mouth of the first nozzle, wherein the offset (OS) distance along the central axis between the mouth of the first nozzle and the mouth of the second nozzle is between 0.5 and 5 mm;

wherein the first nozzle and the second nozzle are positioned so as to result in:

(i) mixing of the air and the feed water at the mouth of the second nozzle when the device is in operation and (ii) water from the first nozzle forming a film around the second nozzle when the device is in operation;

and wherein the second nozzle does not co-axially surround the first nozzle; and b. a detergent dosing device comprising a chamber, wherein the chamber comprises a detergent composition, and wherein the chamber is positioned between the feed water source and the first nozzle;

wherein the detergent dosing device comprises an auto-shut-off device configured to close a water inlet and/or an outlet of the dosing device when the detergent composition is spent.

2. A system according to claim 1, wherein the detergent composition is a solid detergent composition comprising:

c. 20-40% w of a surfactant d. 0-40% w of a builder e. 0-10% w of a bleaching ingredient f. 0-2% of minors g. balance salt.

3. A system according to claim 1, wherein the detergent composition is a liquid detergent composition comprising:

h. 20-40% w of a surfactant i. 0-40% w of a builder j. 0-10% w of a bleaching ingredient k. 0-2% w of minors l. balance solvent.

* * * * *